US008359892B1

(12) United States Patent
Karty

(10) Patent No.: US 8,359,892 B1
(45) Date of Patent: Jan. 29, 2013

(54) REBAR BENDING DEVICE

(76) Inventor: Marcus Karty, Simi Valley, CA (US)

( * ) Notice: Subject to any disclaimer, the term of this patent is extended or adjusted under 35 U.S.C. 154(b) by 292 days.

(21) Appl. No.: 12/914,711

(22) Filed: Oct. 28, 2010

(51) Int. Cl.
*B21J 13/08* (2006.01)
*B21D 7/024* (2006.01)

(52) U.S. Cl. ..... 72/31.05; 72/218; 72/388; 72/458; 72/479; 81/177.1; 81/177.7; 81/177.8; 140/106

(58) Field of Classification Search ..... 72/31.01, 72/31.04, 31.05, 149, 217, 218, 387, 388, 72/457, 458, 479; 140/102.5, 106; 81/177.1, 81/177.7, 177.8
See application file for complete search history.

(56) References Cited

U.S. PATENT DOCUMENTS

| | | | | | |
|---|---|---|---|---|---|
| 2,675,723 | A | * | 4/1954 | Stein | 72/458 |
| 3,732,721 | A | * | 5/1973 | Cusimano | 72/458 |
| 3,743,747 | A | | 3/1976 | Wesler et al. | |
| 4,009,602 | A | | 3/1977 | Linquist | |
| 4,304,117 | A | * | 12/1981 | Rawson | 72/388 |
| 4,794,779 | A | * | 1/1989 | Schweitzer | 72/390.4 |
| 4,798,078 | A | * | 1/1989 | Schweitzer | 72/390.4 |
| 4,887,447 | A | * | 12/1989 | Schweitzer | 72/332 |
| D334,754 | S | | 4/1993 | Pearson et al. | |
| 5,653,139 | A | * | 8/1997 | Lee | 72/217 |
| 5,669,258 | A | | 9/1997 | Luebke | |
| D416,566 | S | | 11/1999 | Perez | |
| 6,128,944 | A | * | 10/2000 | Haynes | 72/458 |
| 6,418,773 | B1 | * | 7/2002 | Tolman | 72/458 |
| 6,497,133 | B1 | * | 12/2002 | Rose | 72/388 |
| 6,993,950 | B2 | * | 2/2006 | Bryan | 72/214 |
| 6,997,030 | B1 | * | 2/2006 | Williams | 72/458 |
| 7,624,608 | B1 | | 12/2009 | Karty | |

* cited by examiner

*Primary Examiner* — Dana Ross
*Assistant Examiner* — Onekki Jolly

(57) ABSTRACT

A rebar bending device for bending rebar. The device features a base plate and a rotator plate pivotally attached to the top of the base plate. A top plate is attached atop the rotator plate. A first pin extends from the base plate through the rotator plate and through the top plate. The rotator plate can rotate about the first pin with respect to the base plate and top plate. An arc-shaped slots are disposed in the top plate, which is adapted to receive a dial pin that is anchored to the rotator plate. A dial is marked atop the top plate (the second marker plate). A second pin is disposed on the top of the top plate near the first pin and a third pin is disposed on the top of the rotator plate.

16 Claims, 17 Drawing Sheets

REBAR BENDING DEVICE

FIELD OF THE INVENTION

The present invention is directed to a device for bending metal bars, such as bars used to reinforce concrete (e.g., rebars). More particularly, the present invention is directed to a rebar bending device that is portable.

BACKGROUND OF THE INVENTION

The present invention features a rebar bending device for allowing a user to bend a bar used to reinforce concrete (e.g., a rebar). In some embodiments, the rebar bending device can be mounted on a tripod, mounted on a bed of a pickup truck, mounted on a trailer hitch, and/or mounted on similar devices.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

BRIEF DESCRIPTION OF THE DRAWINGS

FIG. 10 shows the first marker plate and second marker plate as separate from the extension plate and top plate, respectively.

DESCRIPTION OF PREFERRED EMBODIMENTS

Figure 1:
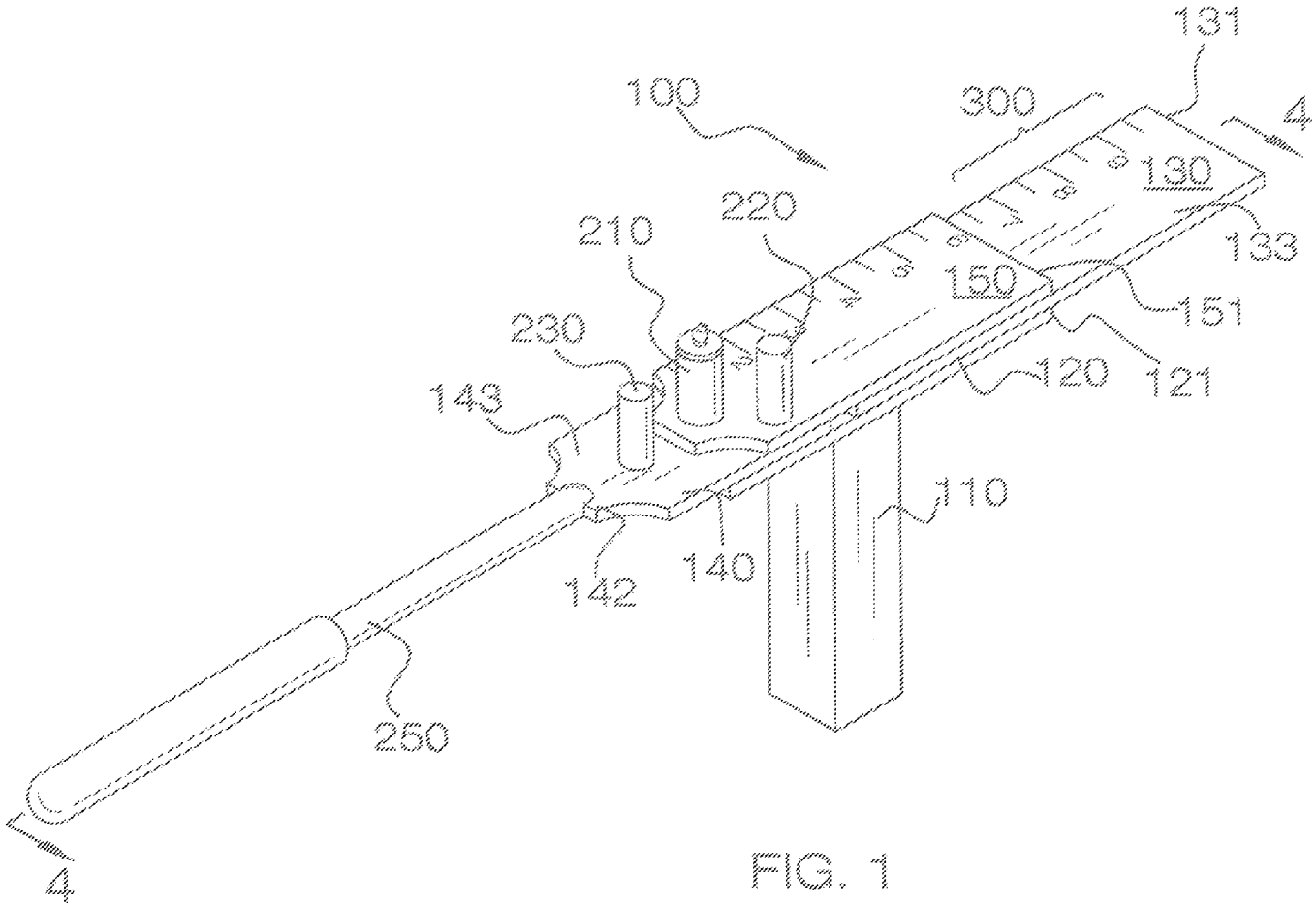
FIG. 1 is a perspective view of the rebar bending device of the present invention.

The present invention features a rebar bending device 100 for allowing a user to bend a bar used to reinforce concrete (e.g., a rebar 500). In some embodiments, the rebar bending device 100 can be mounted on a tripod, mounted on a bed of a pickup truck, mounted on a trailer hitch 510, and/or mounted on similar devices.

Referring now to FIGS. 1-17, the rebar bending device 100 comprises a base plate 120 having a top surface 123, a bottom surface 124, a first end 121, and a second end 122. In some embodiments, a support beam 110 (or support beam mounting plate) is attached to the bottom surface 124 of the base plate 120. The support beam 110 (or support beam mounting plate) is for allowing the rebar bending device 100 to be mounted on a device such as a bed of a pickup truck, a tripod 520, a trailer hitch 510, or the like (e.g., see FIG. 14, FIG. 15). In some embodiments, the base plate 120 is secured to the support beam mounting plate or support beam 110 via bolts, screws, welding, the like, or a combination thereof.

Figure 10:
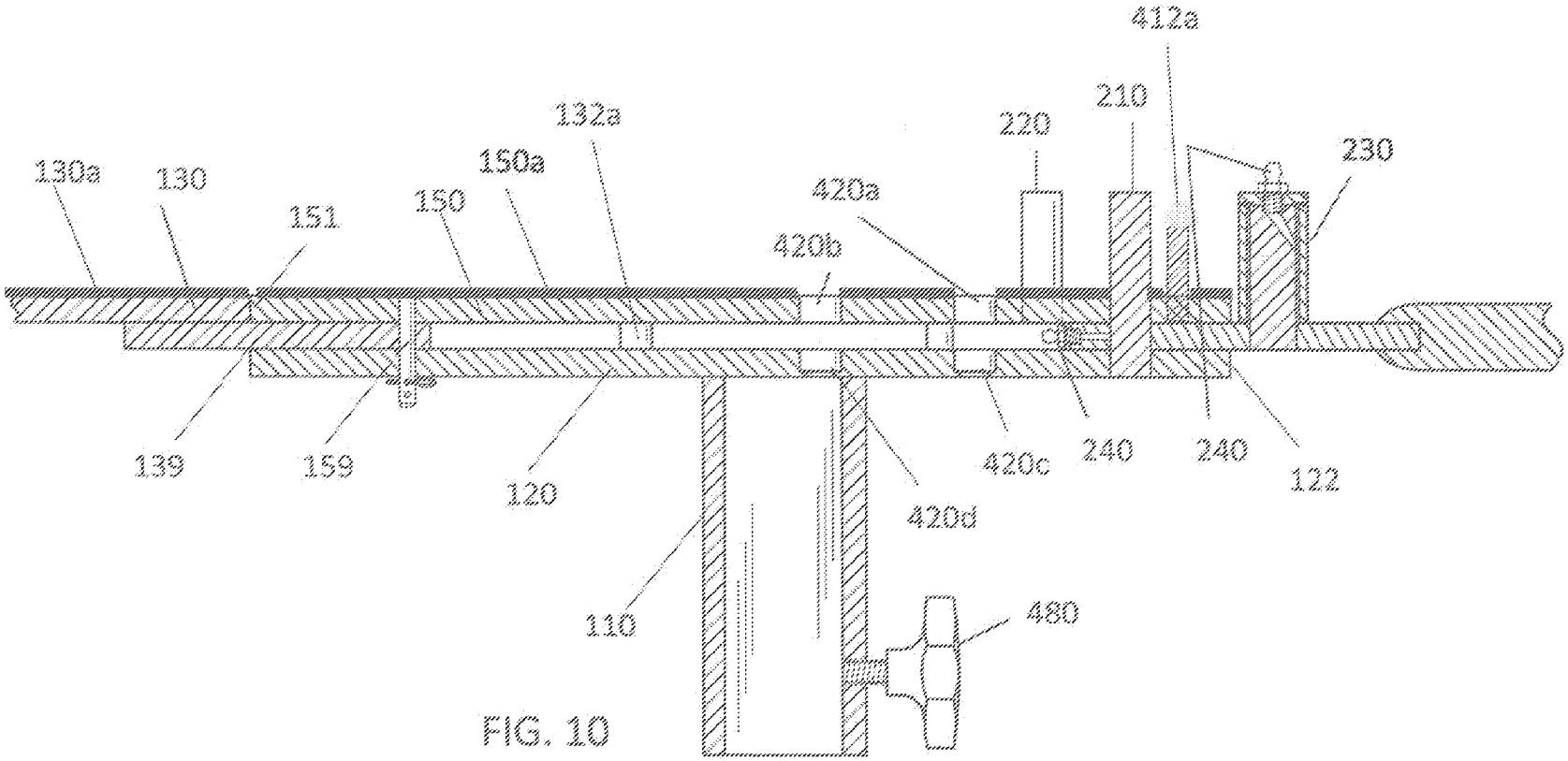
FIG. 10 is a side cross sectional view of the rebar bending device of the present invention.
Figure 11:
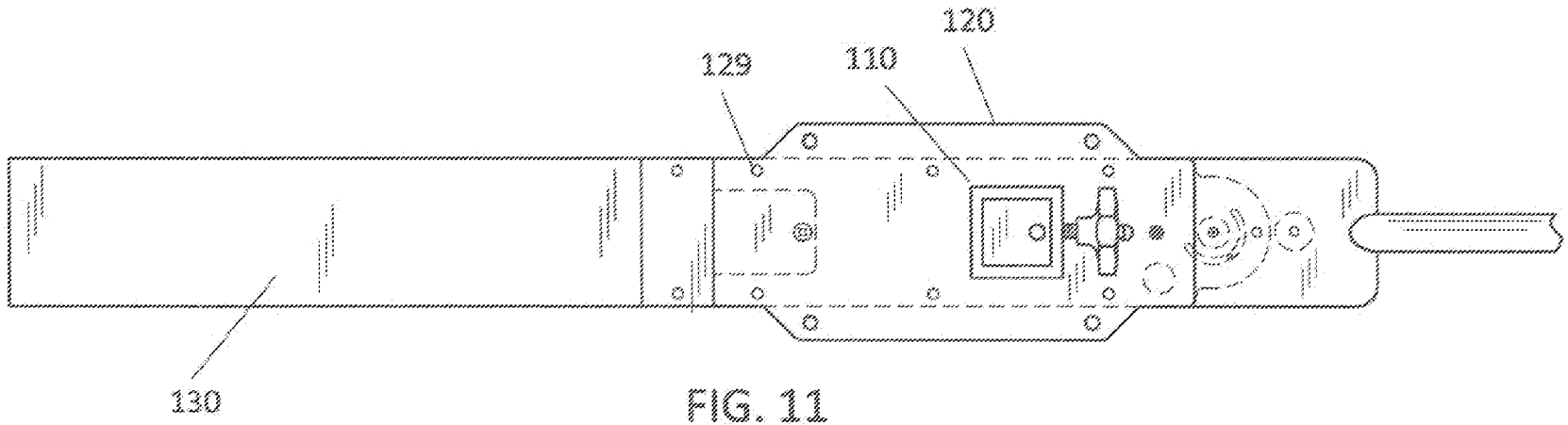
FIG. 11 is a bottom view of the rebar bending device of the present invention.

A first pin 210 (e.g., steel pin) is disposed at or near the second end 122 of the base plate 120 and extends upwardly from the second end 122 of the base plate 120 (e.g., see FIG. 10). In some embodiments, a first washer is disposed on the first pin 210.

A rotator plate 140 is attached (e.g., not fixedly) to the top surface 123 of the base plate 120 at or near the second end 122. The rotator plate 140 has a top surface 143, a bottom surface 144, a first end 141, and a second end 142. A first pin aperture 140*a* is disposed in the rotator plate 140 near the first end 141 (the end facing the base plate 120) (e.g., see FIG. 16). The first pin aperture 140*a* is adapted to slide over the first pin 210 on the base plate 120, allowing the first pin 210 to extend upwardly through the rotator plate 140. The first washer (e.g., surrounding the first pin 210) may be sandwiched between the base plate 120 and the rotator plate 140. The rotator plate 140 can rotate about the first pin 210 (e.g., see FIG. 2). A second washer may be disposed on the first pin 210 (above the rotator plate 140).

Disposed on the second end 142 of the rotator plate 140 is a handle 250. The handle 250 allows the user to easily rotate the rotator plate 140 about the first pin 210 (e.g., see FIG. 12). In some embodiments, a handle stub 250*a* (e.g., 12 inches) is disposed on the second end 142 of the rotator plate 140, wherein the handle 250 slides over the handle stub 250*a*.

A first arc-shaped slot 140*b* is disposed in the rotator plate 140 surrounding the pin aperture 140*a*. The first arc-shaped slot 140*b* has a first end and a second end, the ends facing the first end 141 of the rotator plate 140.

Figure 8:
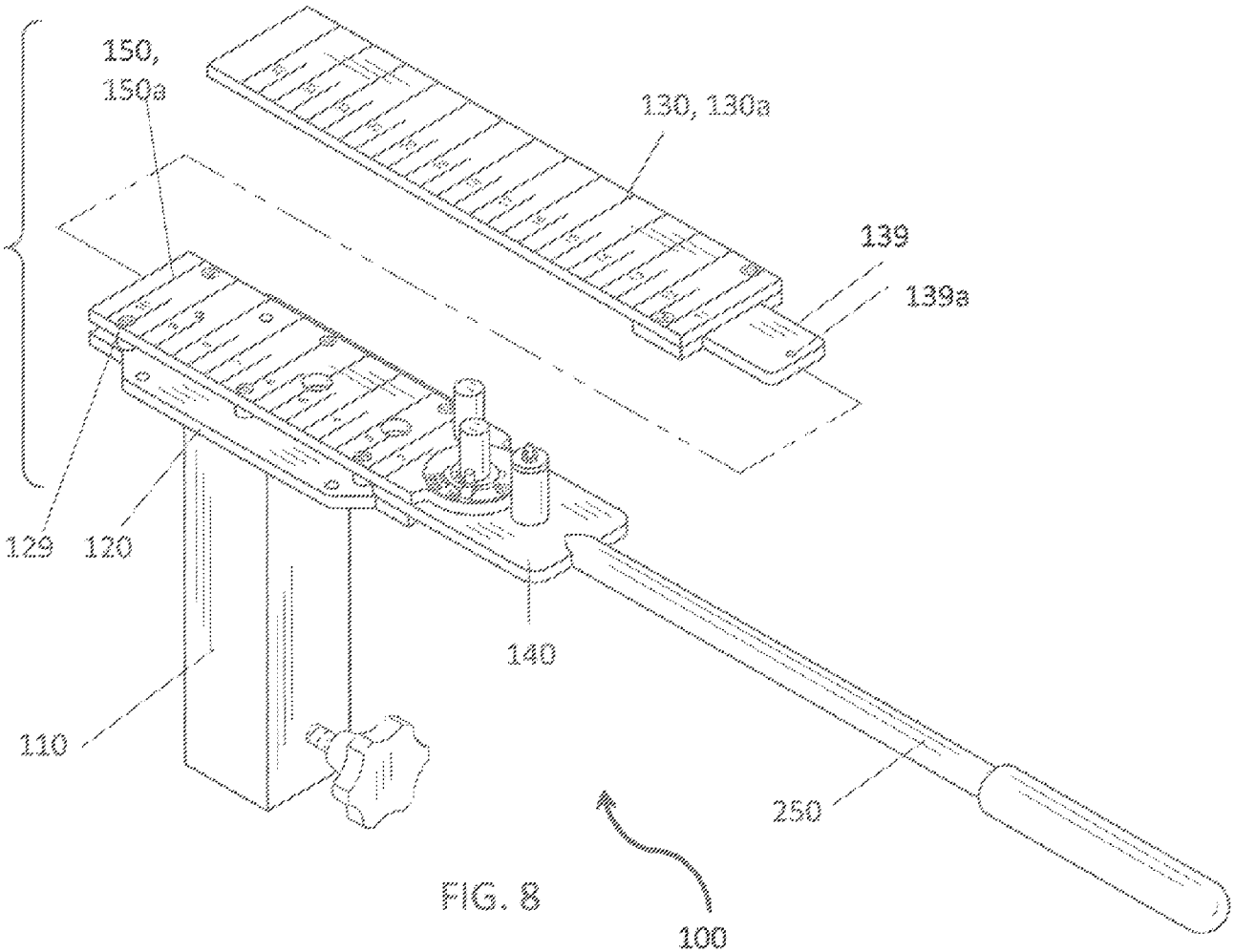
FIG. 8 is a perspective view of the rebar bending device of the present invention.

A top plate 150 is attached atop the rotator plate 140 (e.g., atop the top surface 143 at the first end 141) and over the top surface 123 of the base plate 120 (e.g., see FIG. 8). The top plate 150 has a top surface 153, a bottom surface 154, a first end 151, and a second end 152, the second end 152 being positioned atop the rotator plate 140. A space exists between a portion of the top plate 150 and a portion of the base plate 120. In some embodiments, spacers 132*a* are sandwiched between the top plate 150 and the base plate 120 (e.g., see FIG. 10). A second pin aperture 152*a* is disposed in the top plate 150 at or near the second end 152, the second pin aperture 152*a* is adapted to slide over the first pin 210, allowing the first pin 210 to extend upwardly through the top plate 150. The second washer (e.g., surrounding the first pin 210) may be sandwiched between the rotator plate 140 and the top plate 150. The second end 152 of the top plate 150 does not cover the third pin 230 on the rotator plate 140.

Figure 17:
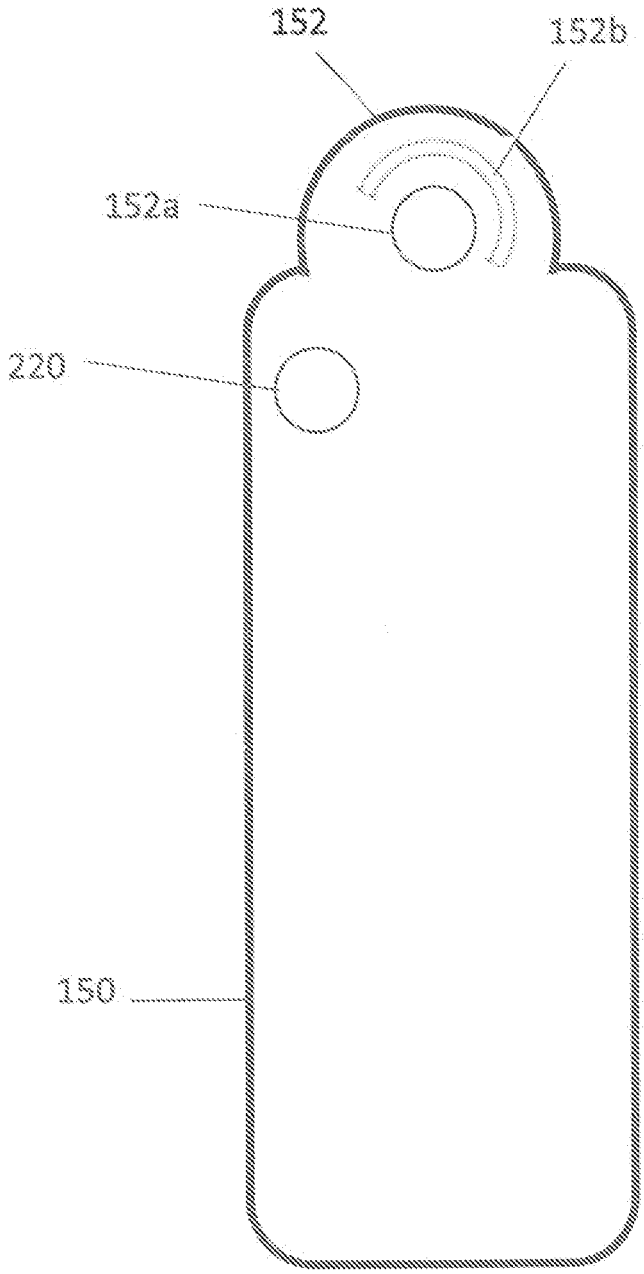
FIG. 17 is a schematic top view of the top plate of the device of the present invention.

A second pin 220 (e.g., steel pin) is disposed on the top surface 153 of the top plate 150 near the second pin aperture in the top plate 150. As shown in FIG. 17, the second pin 220 may be offset from the center line of the top plate 150 (e.g., running from the first end to the second end 152).

A second arc-shaped slot 152*b* is disposed in the top plate 150 surrounding the second pin aperture 152*a*. The second arc-shaped slot 152*b* has a first end and a second end, the ends facing the second pin 220.

The top plate 150 does not pivot like the rotator plate 140 does. The rotator plate 140 can rotate about the first pin 210 between the base plate 120 and the top plate 150. In some embodiments, the top plate 150 is secured to the base plate 150 via an attachment means. The attachment means may include but is not limited to a bolt 159 that extends from the top plate to the base plate 120 (e.g., see FIG. 10). For example, the bolt 159 may extend through a first bolt aperture in the top plate 150 through to a second bolt aperture in the base plate 120. In some embodiments, the attachment means includes a connecting bolt/screw 129 extending from the top plate 150 to the base plate 120 (e.g., through the spacers 132*a*, e.g., see FIG. 8).

Figure 9:
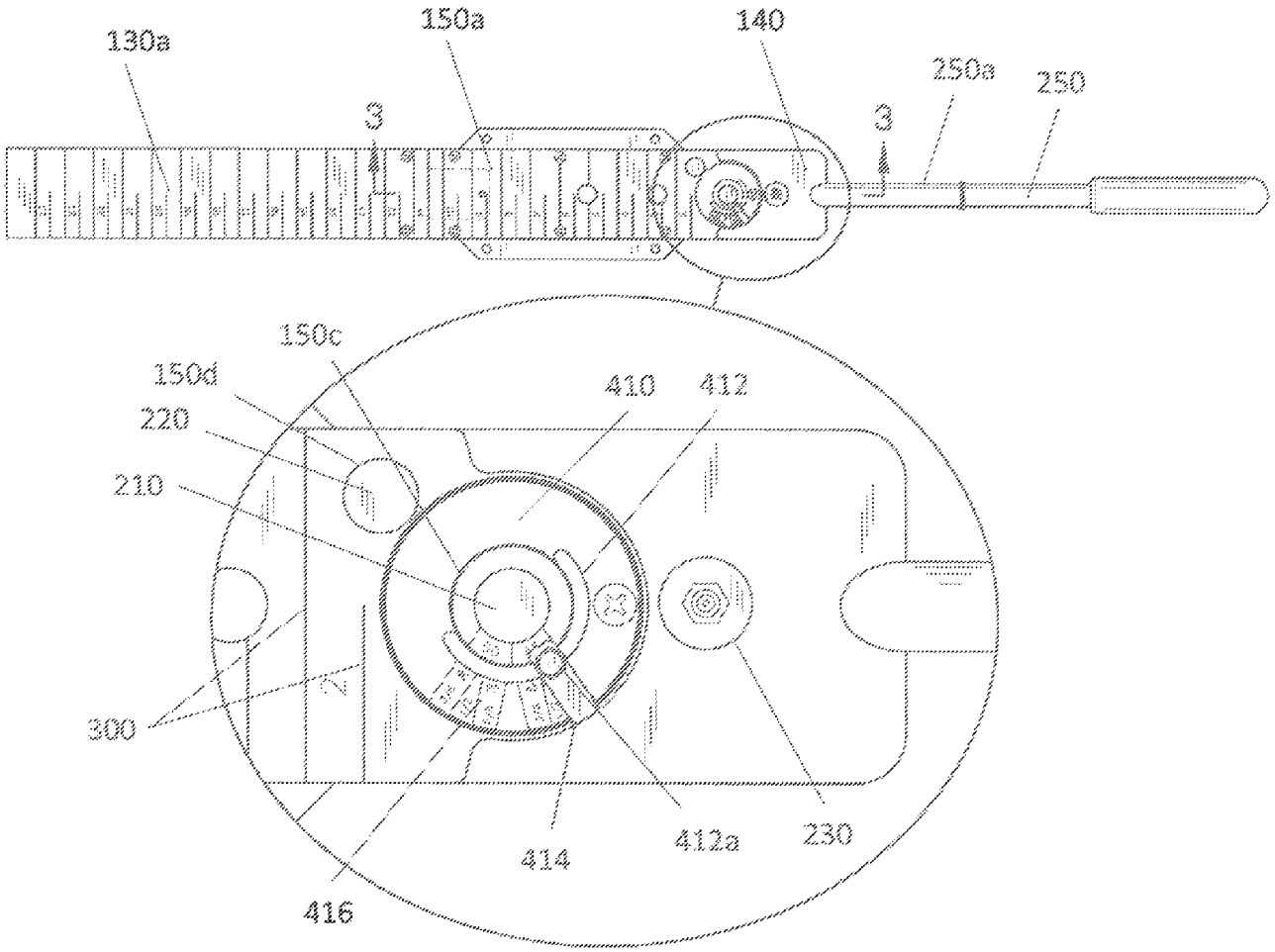
FIG. 9 is a top view of the rebar bending device of the present invention.

The device 100 of the present invention may further comprise a first extension plate 130 for positioning next to (e.g., aligned with) the first end 151 of the top plate 150 (e.g., see FIG. 9, FIG. 10). The first extension plate 130 has a top surface 133, a bottom surface 134, a first end 131, and a second end 132. In some embodiments, the first extension plate 130 is flush with the top plate 150. For example, in some embodiments, a tab 139 is disposed on the bottom surface of the first extension plate and/or on the second end of the first extension plate 130, wherein the tab 139 is adapted to be snugly inserted and sandwiched between the base plate 120 and the first end 151 of the top plate 150 (e.g., FIG. 8 shows the tab 139 of the first extension plate removed from in between the base plate 120 and the top plate 150). FIG. 10 shows the first extension plate 130 flush with the top plate 150 and the tab 139 sandwiched between the base plate 120 and the top plate 150. Alternatively, in some embodiments, the first extension plate 130 is sandwiched between the first end 151 of the top plate 150 and the base plate 120 (e.g., the first end 121 of the base plate 120).

In some embodiments, the first extension plate 130 and the tab 139 are two pieces, and the first extension plate 130 can slide with respect to the tab 139. In some embodiments, the tab can slide between the base plate 120 and the top plate 150.

In some embodiments, a tab aperture 139*a* is disposed on the outer end of the tab 139. The first extension plate 130 may be fixedly or removably attached to the base plate 120. In some embodiments, the bolt 159 that extends through a first bolt aperture in the top plate 150 through to a second bolt aperture in the base plate 120 may further extend through the tab aperture 139*a* disposed in the tab 139 to secure the first extension plate 130 between the base plate 120 and top plate 150 (e.g., see FIG. 10).

In some embodiments, measurement markers 300 are etched into the first extension plate 130 and/or the top plate 150. In some embodiments, a first marker plate 130*a* (e.g., stainless steel plate) is disposed atop the top surface of the first extension plate 130*a*, the first marker plate 130*a* being labeled with a plurality of measurement markers 300. In some embodiments, a second marker plate 150*a* (e.g., stainless steel plate) is disposed atop the top plate 150, the second marker plate 150*a* being labeled with a plurality of measurement markers 300. The marker plates (e.g., stainless steel plates) with measurements engraved on them are one piece. The measurement markers 300 allow the user to determine where the rebar 500 should be bent. In some embodiments, the second marker plate 150*a* comprises a third pin aperture 150*c* and/or a fourth pin aperture 150*d* to accommodate the first pin 210 and second pin 220, respectively (e.g., the second marker plate 150*a* slides over the first pin 210 and second pin 220 to be attached atop the top plate 150. A third arc-shaped slot 412 may be disposed in the second marker plate 150*a* surrounding the third pin aperture. The third arc-shaped slot 412 aligns with the second arc shaped slot 152*b* on the top plate 150 when the second marker plate 150*a* is placed atop the top plate 150.

Figure 2:
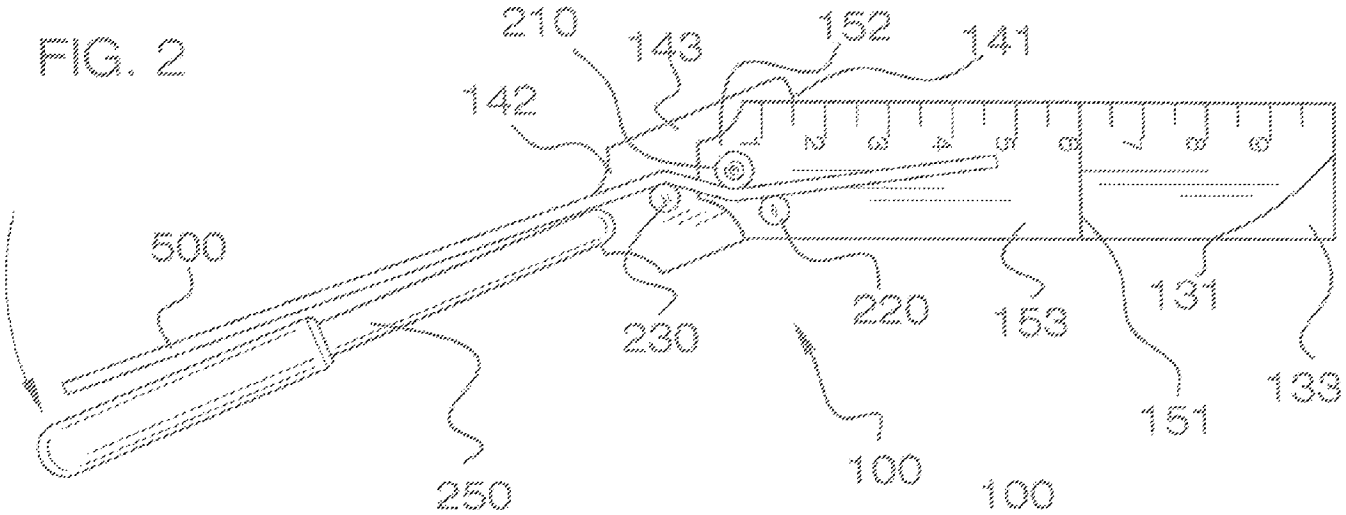
FIG. 2 is a top view of the rebar bending device of the present invention.
Figure 3:
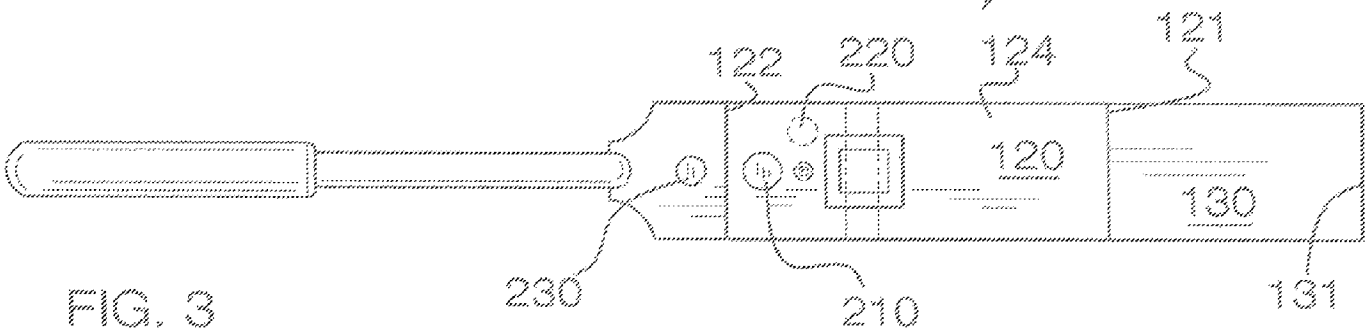
FIG. 3 is a bottom view of the rebar bending device of the present invention.
Figure 4:
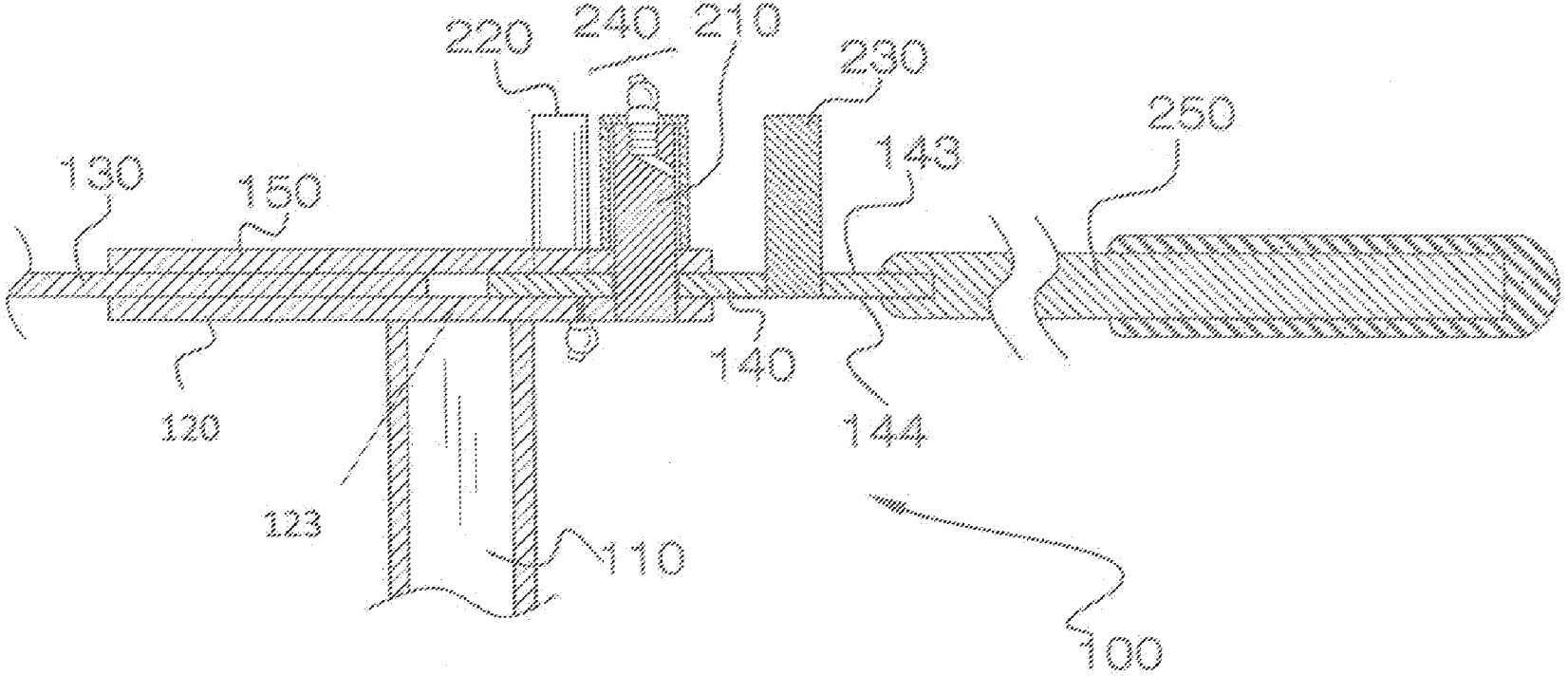
FIG. 4 is a side and cross sectional view of the rebar bending device of the present invention.
Figure 5:
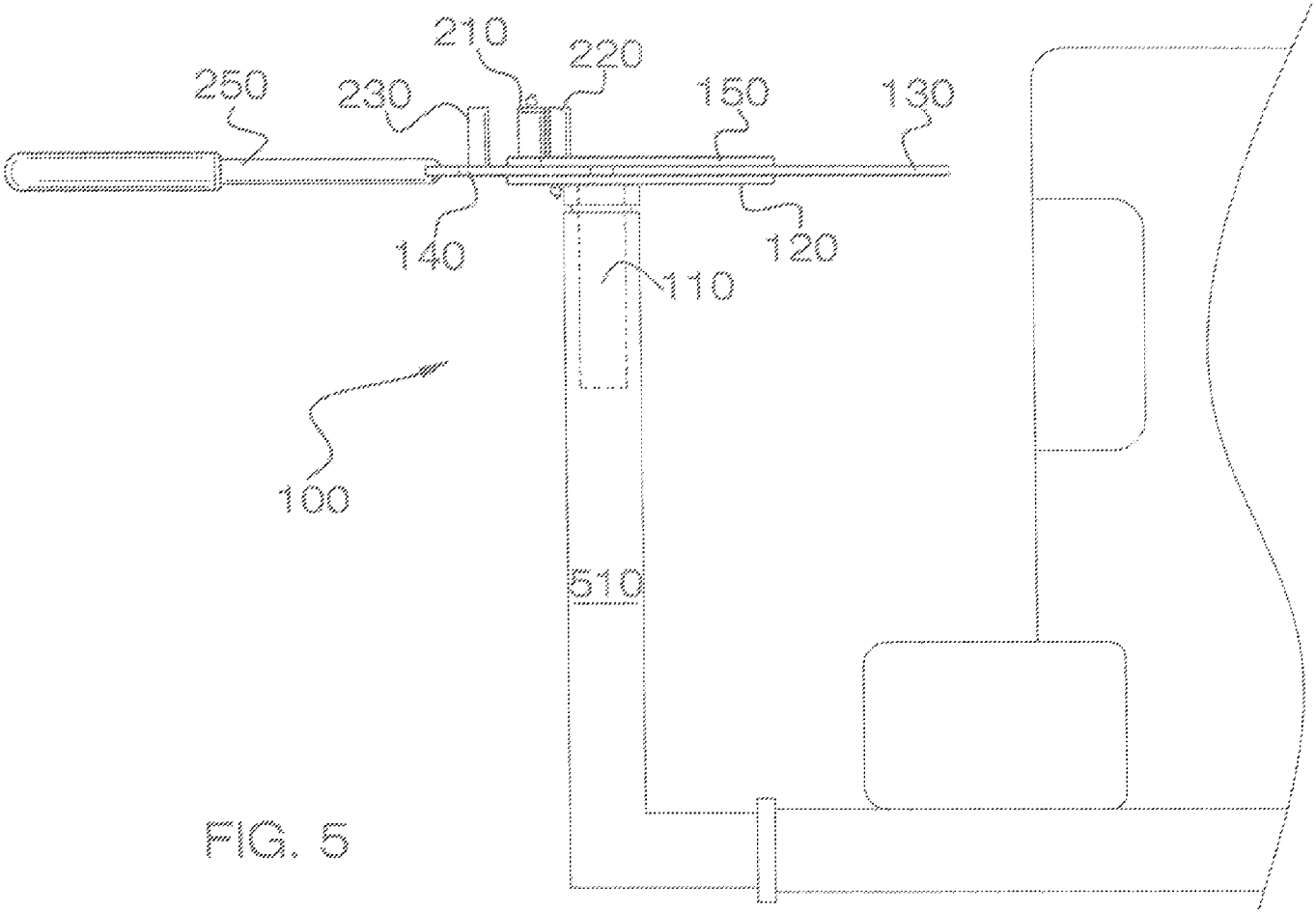
FIG. 5 is a side view of the rebar bending device of the present invention.
Figure 6:
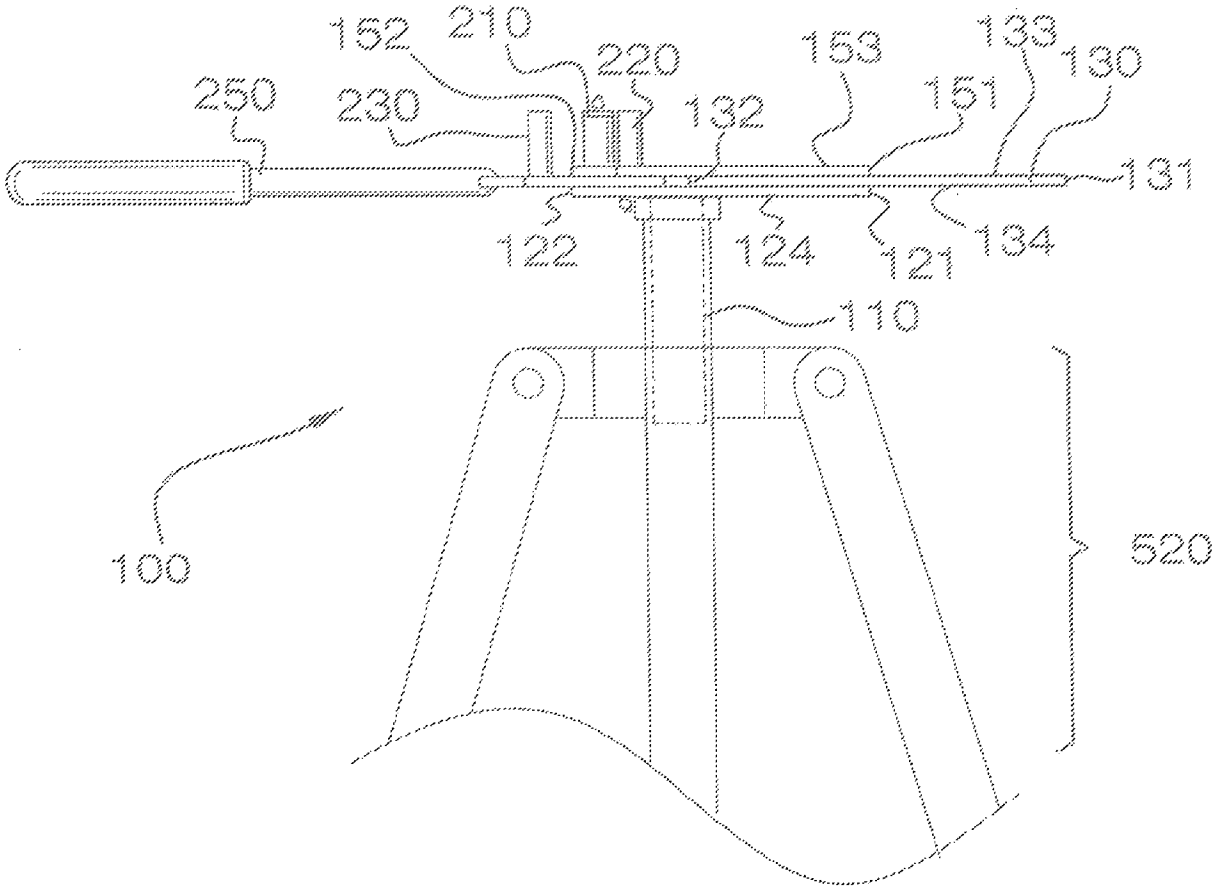
FIG. 6 is a side view of the rebar bending device of the present invention.

A piece of rebar 500 can be positioned in between the first pin 210, the second pin 220, and the third pin 230 (for example, see FIG. 2). When a piece of rebar 500 is positioned in between the pins, a user can rotate the rotator plate 140 via the handle 250, which causes the rebar 500 to bend. In some embodiments, a piece of rebar 500 is placed between the first pin 210 and the second pin 220 as well as between the first pin 210 and the third pin 230. In some embodiments, the piece of rebar 500 is placed between the first pin 210 and the second pin 220 as well as between the second pin 220 and the third pin 230.

Figure 7:
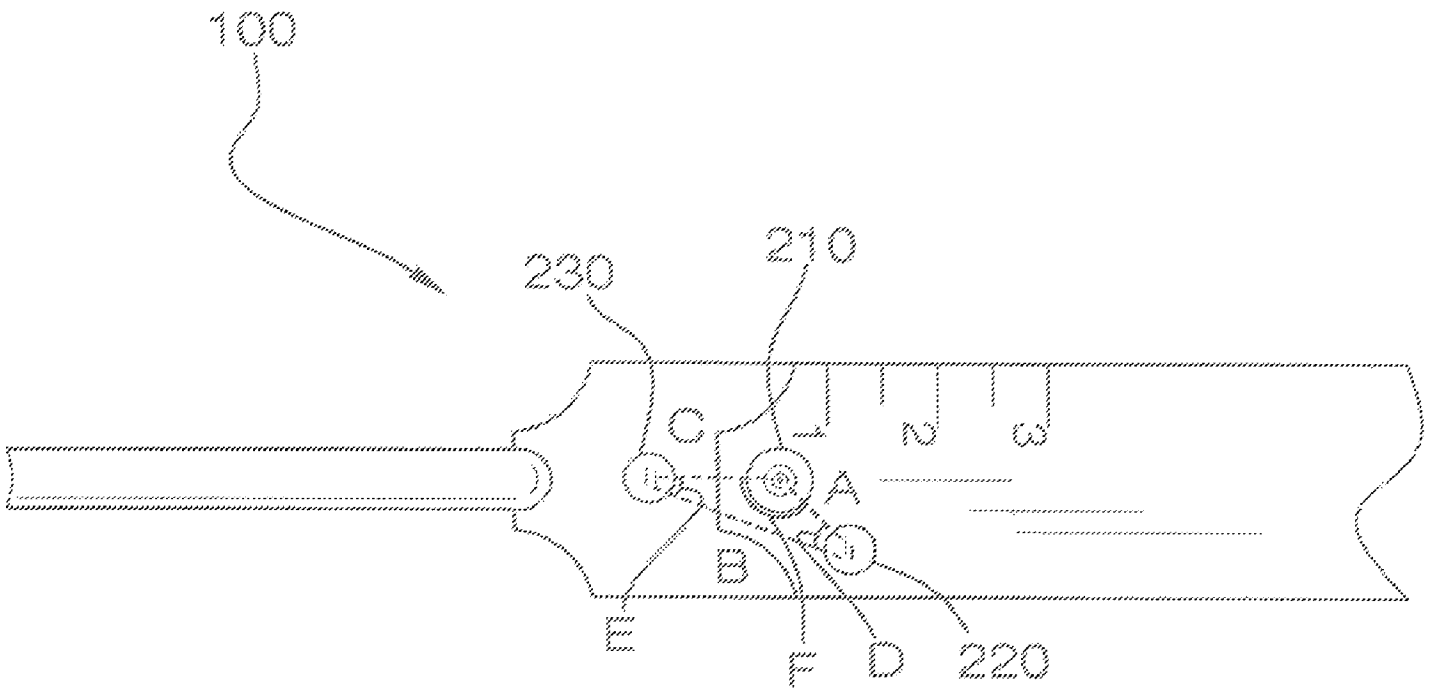
FIG. 7 is a top view of the rebar bending device of the present invention.

The first pin 210, the second pin 220, and the third pin 230 each have a center. As shown in FIG. 7, the distance between the center of the second pin 220 and the center of the third pin 230 is designated as distance B. The distance between the center of the first pin 210 and the center of the second pin 220 is designated as distance A. The distance between the center of the first pin 210 and the center of the third pin 230 is designated as distance C. The angle between distance A and distance B is angle D. The angle between distance B and distance C is angle E. The angle between distance A and distance C is angle F.

Figure 12:
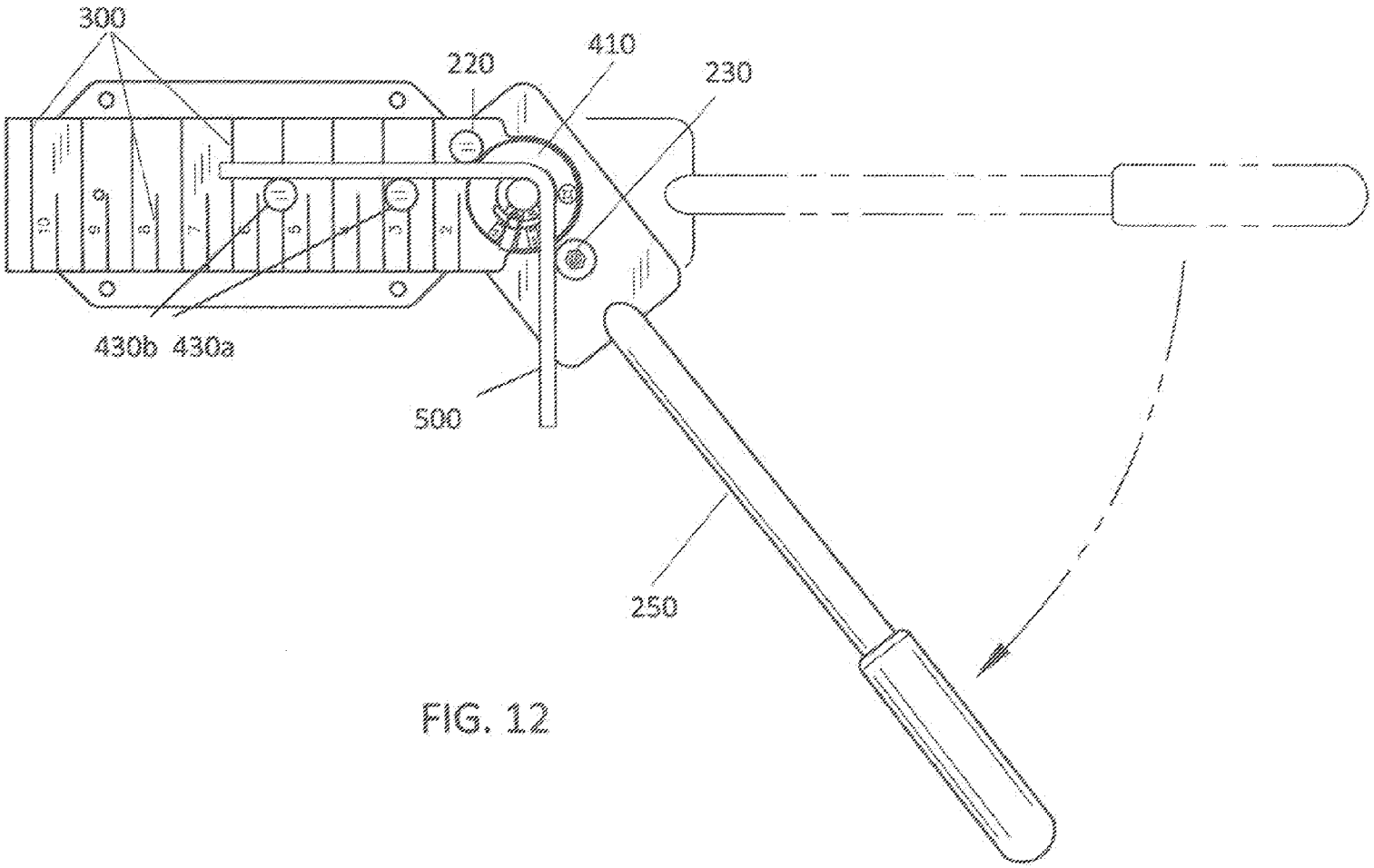
FIG. 12 is a top view of the rebar bending device of the present invention.
Figure 13:
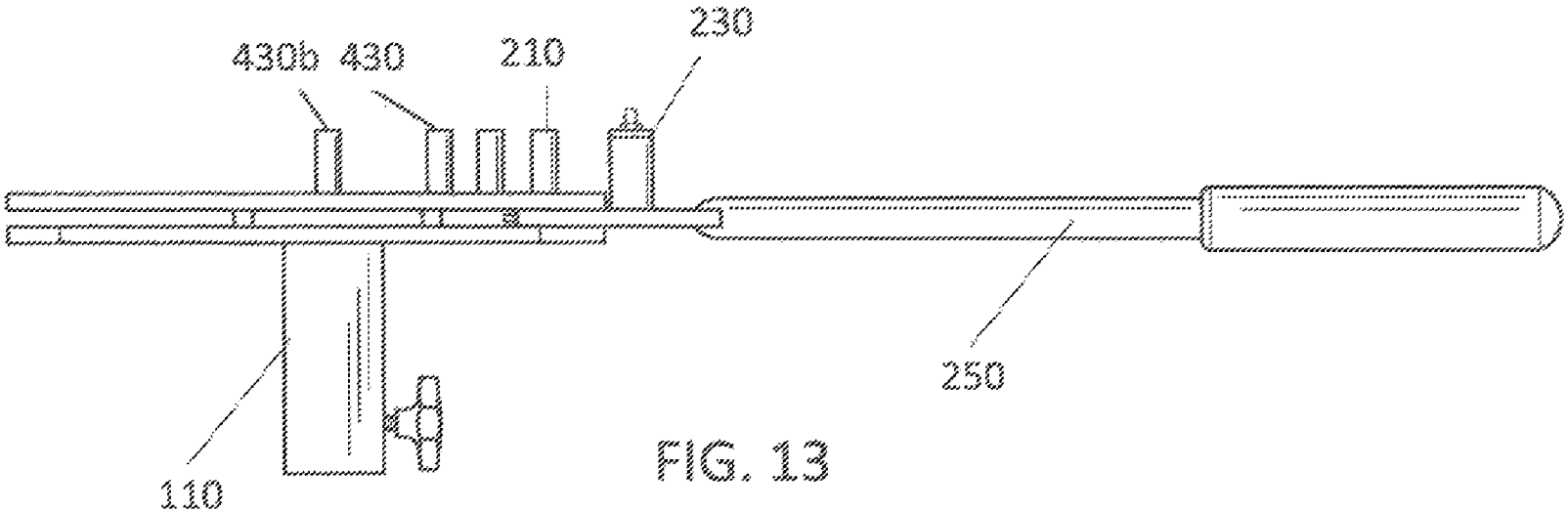
FIG. 13 is a side view of the rebar bending device of the present invention.

As shown in FIG. 10, in some embodiments, a first supplemental aperture 420*a* is disposed in the top plate 150, for example near the second pin 220. In some embodiments, a second supplemental aperture 420*b* is disposed in the top plate 150, for example near the first supplemental aperture 420*a*. In some embodiments, a third supplemental aperture 420*c* may be disposed in the base plate 120 positioned below and aligned with the first supplemental aperture 420*a*. In some embodiments, a fourth supplemental aperture 420*d* may be disposed in the base plate 120 positioned below and aligned with the second supplemental aperture 420*b*. The supplemental apertures 420 allow supplemental pins 430 to be inserted into the device 100. For example, as shown in FIG. 12, a first supplemental pin 430*a* can be inserted into both the first supplemental aperture 420*a* and the third supplemental aperture 420*c*, and a second supplemental pin 430*b* can be inserted into both the second supplemental aperture 420*b* and the fourth supplemental aperture 420*d*. The supplemental pins 430 provide additional means of bending a rebar 500. For example, as shown in FIG. 12, a rebar 500 can be positioned in between the first pin 210 and third pin 230, between the first pin 210 and the second pin 220, and between the second pin 220 and the supplemental pins 430 (and bent accordingly). The supplemental pins 430, for example, may allow for a 180 degree bend.

The second end 152 of the top plate 150 may be constructed in a rounded shape (e.g., partially circular, e.g., see FIG. 17), however the second end 152 of the top plate 150 is not limited to this configuration. A dial 410 is marked on the top plate 150 around the second pin aperture 152*a* and second arc-shaped slot 152*b* or on the second marker plate 150*a* around the third pin aperture and third arc-shaped slot 412 (e.g., see FIG. 9, FIG. 12). The dial 410 is labeled with dial measurement markings 416 disposed in between the third pin aperture and third arc-shaped slot 412 and outside of the third arc-shaped slot 412 (e.g., see FIG. 9). The dial measurement markings 416 may reflect different sizes of rebar, for example the markings may show ⅜", ½", ⅝", the like, or a combination thereof. The dial measurement markings 416 may also provide a user with information about a bending angle (e.g., 45 degrees, 90 degrees, 30 degrees, etc.). As shown in FIG. 9, the dial measurement markings 416 comprise a first set of markings that surrounds a portion of the third pin aperture (e.g., the first pin 210), wherein the first set of markings is 90 and 45), and a second set of markings that surrounds a portion of the third arc-shaped slot 412, wherein the second set of markings is ⅜, ½, and ⅝. In some embodiments, the dial measurement markings 416 comprises two of the second set of markings (⅜, ½, ⅝, one which surrounds the 90 of the first set of markings and the second that surrounds the 45 of the first set of markings.

Figure 9A:
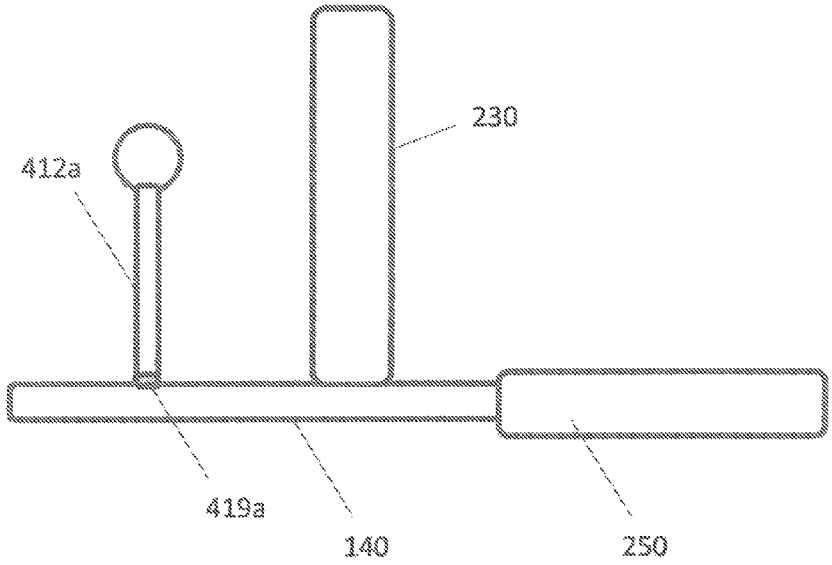
FIG. 9A is a side view of the rotator pate of the device of the present invention showing the dial pin.

A dial pin 412*a* (e.g., radius pin) is inserted into the third arc-shaped slot 412 and second arc-shaped slot 152*b*. The dial pin 412*a* (e.g., radius pin) screws into a dial pin mount 419*a* disposed on the rotator plate 140 adjacent to the first arc-shaped slot 140*b* (e.g., see FIG. 17). The dial pin 412*a* extends through the third arc-shaped slot 412 and second arc-shaped slot 152*b*. FIG. 9A shows a side view of the handle 250 and rotator plate 140 with the dial pin 412*a*. The dial pin 412*a* rotates with the handle 250 when the handle 250 is moved. As the handle 250 and rotator plate 140 are turned (pivoted) with respect to the base plate 120 and top plate 150, the dial pin 412*a* slides within the third arc-shaped slot 412 and second arc-shaped slot 152*b*. The measurement 416 that the dial pin 412*a* aligns with can help a user determine what angle he/she is bending the rebar (e.g., depending on the size of the rebar).

As shown in FIG. 10, there are three plates: the base plate 120, the top plate 150, and the second marker plate 150*a* (e.g., stainless steel plate). Also shown in FIG. 10 is the rotator plate 140 sandwiched between the top plate 150 and base plate 120 and extension plate 130 (with first marker plate 130*a*).

In some embodiments, a bending guide 414 extends from the dial pin 412*a* around the outer edge of the second end 152 of the top plate 150.

In some embodiments, the first pin 210, and/or the third pin 230, and/or the rotator plate 140 are equipped with a grease fitting 240 (e.g., a zerk fitting). For example, in some embodiments, the first end of the rotator plate 140 (e.g., the end facing the first extension plate 130 or tab 139) is equipped with a grease fitting (e.g., a zerk fitting). Grease fittings are lubrication fittings used in mechanical systems to add grease. In some cases, grease fittings are installed by a threaded connection and have a nipple connection for connecting/attaching a grease gun. Grease can be added to the system (e.g., threaded connection) from the grease gun via the nipple connection. Grease fittings are well known to one of ordinary skill in the art, for example grease fittings are lubrication fittings used in mechanical systems to add grease. A grease fitting may be advantageous as it may make bending rebar easier and/or smoother.

Figure 14:
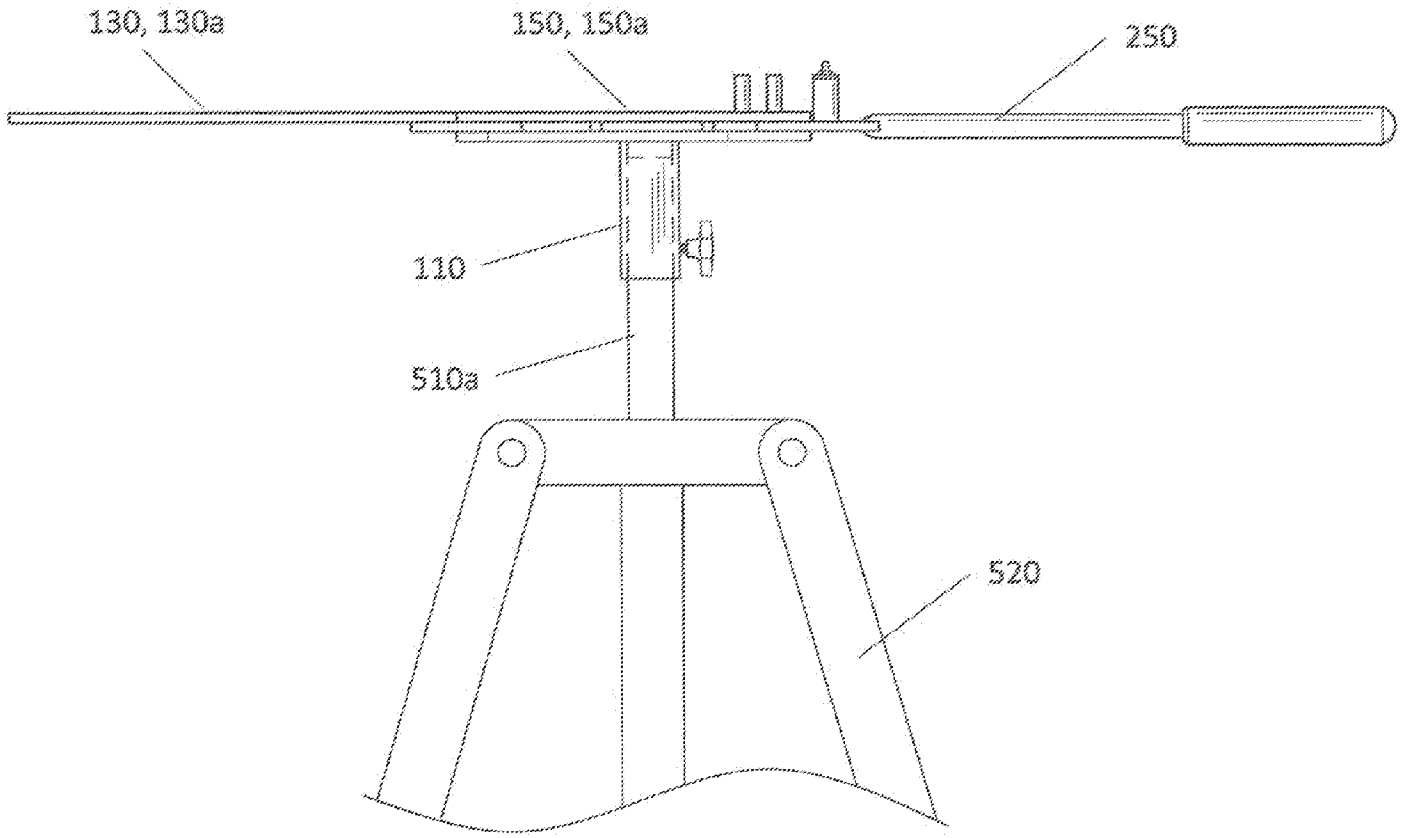
FIG. 14 is a first in-use view of the rebar bending device of the present invention as engaged with a tripod device.
Figure 15:
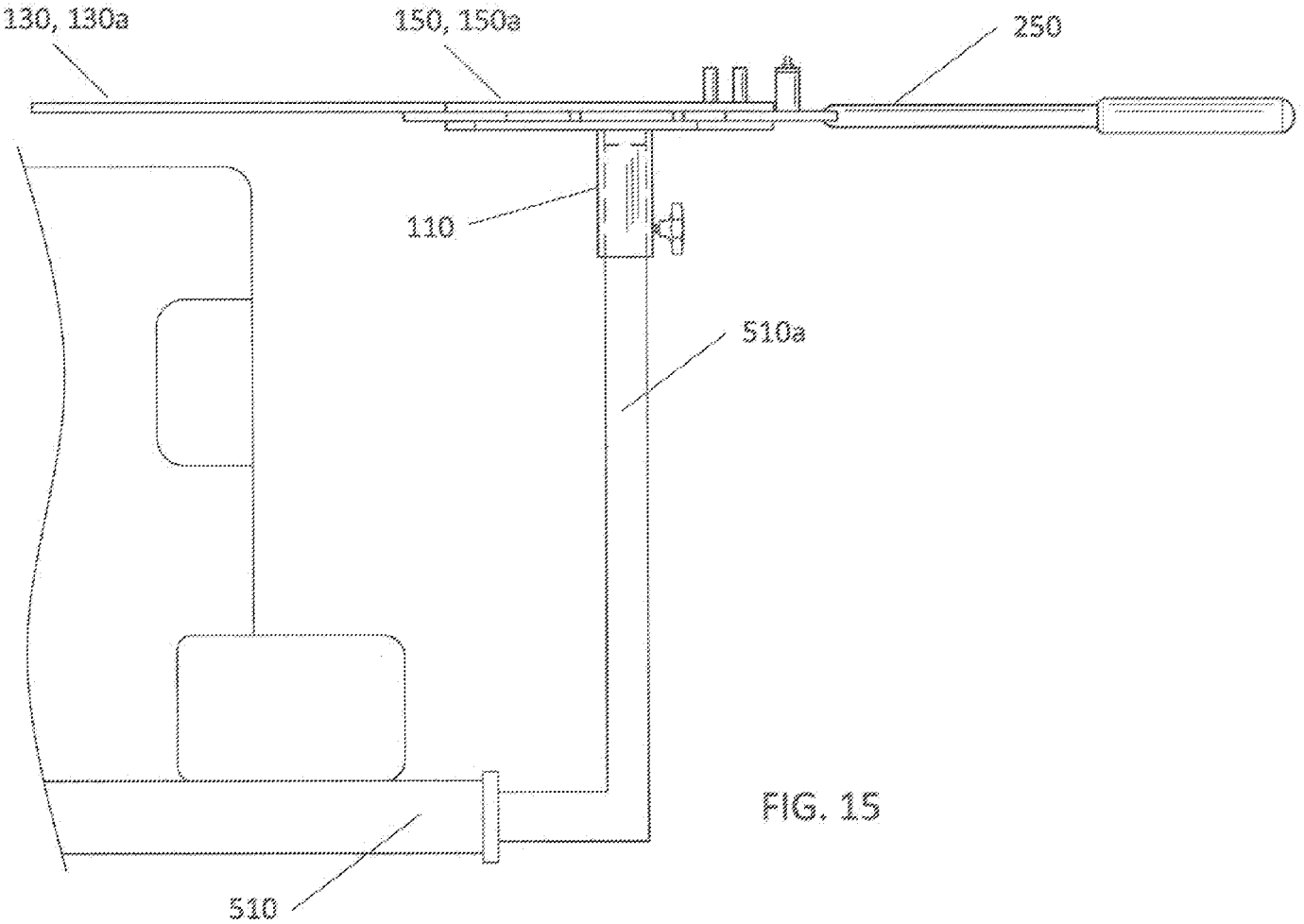
FIG. 15 is a second in-use view of the rebar bending device of the present invention as engaged with a trailer hitch.
Figure 16:
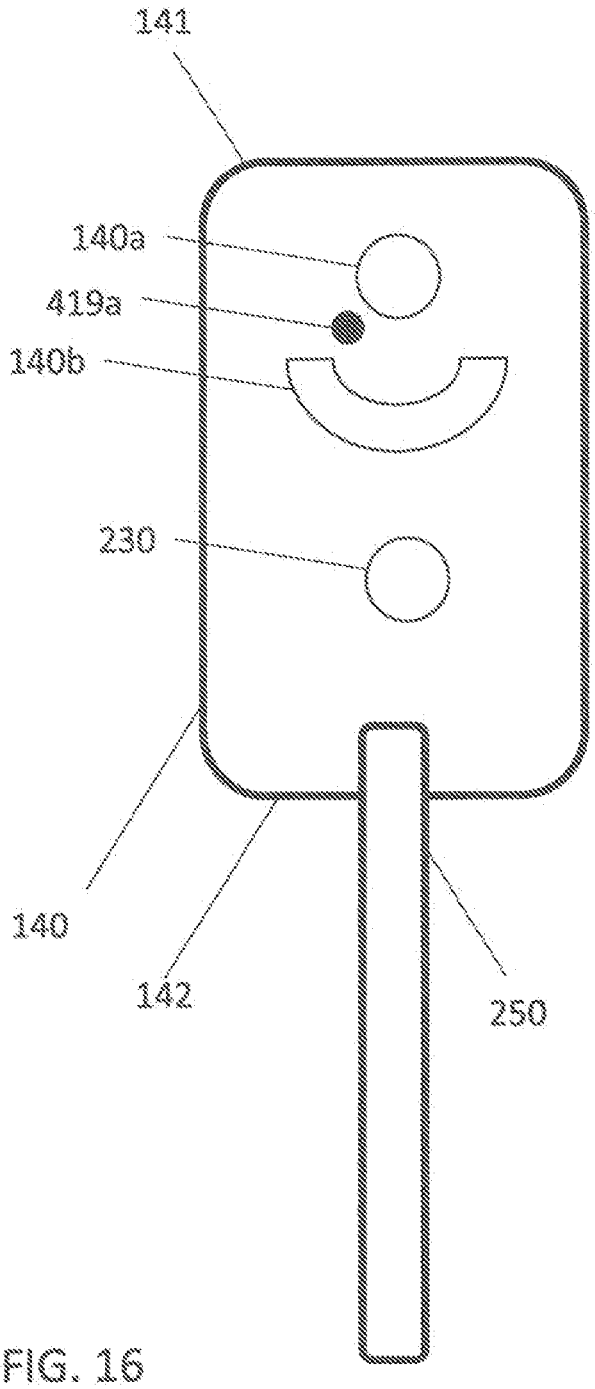
FIG. 16 is a schematic top view of the handle (rotator plate) of the device of the present invention.

As shown in FIG. 14 and FIG. 15, the support beam 110 may be generally hollow (e.g., see FIG. 10), for example an inner channel is disposed in the support beam 110 adapted to accept a secondary post 510*a*, for example a secondary post 510*a* extending from a tripod device 520, a hitch 510, or the like. A locking knob 480 may be disposed on the support beam 110, wherein the locking knob 480 functions to secure the device 100 of the present invention to the secondary post 510*a*. For example, the locking knob 480 may feature a threaded bolt that can be moved inwardly and outwardly into and out of the inner channel of the support beam 110 (e.g., by turning the locking knob 480 in the first direction and second direction, respectively). The threaded bolt can provide pressure against the secondary post 510*a* to secure the support beam 110 onto the secondary post 510*a*.

The rebar bending device 100 of the present invention may be constructed from a variety of materials. For example, in some embodiments, the rebar bending device 100 may be constructed from a material comprising a metal (e.g., steel), a plastic, the like, or a combination thereof.

The rebar bending device 100 may be constructed in a variety of different sizes and the present invention is not limited to any of the dimensions described herein. For example, in some embodiments, the rebar bending device 100 is between about 20 to 30 inches in length, for example about 24 inches, as measured from the first end 131 of the first extension plate to the second end 142 of the rotator plate 140. In some embodiments, the base plate 120 and/or first extension plate 130 and/or top plate 150 and/or rotator plate 140 is between about 8 to 12 inches in length as measured from the first end to the second end. In some embodiments, the base plate 120 and/or first extension plate 130 and/or top plate 150 and/or rotator plate 140 is between about 12 to 16 inches in length as measured from the first end to the second end. In some embodiments, the base plate 120 and/or first extension plate 130 and/or top plate 150 and/or rotator plate 140 is between about 16 to 20 inches in length as measured from the first end to the second end. In some embodiments, the base plate 120 and/or first extension plate 130 and/or top plate 150 and/or rotator plate 140 is more than about 20 inches in length.

For example, in some embodiments, distance A is about 1.75 inches, distance B is about 3 inches, and distance C is about 1.75 inches. In some embodiments, angle D is about 31 degrees, angle E is about 31 degrees, and angle F is about 118 degrees. In some embodiments, distance A is between about 1.0 to 1.25 inches. In some embodiments, distance A is between about 1.25 to 1.5 inches. In some embodiments, distance A is between about 1.5 to 1.75 inches. In some embodiments, distance A is between about 1.75 to 2.0 inches. In some embodiments, distance A is more than about 2.0 inches. In some embodiments, distance B is between about 1.3 to 1.5 inches. In some embodiments, distance B is between about 1.5 to 2.0 inches. In some embodiments, distance B is between about 2.0 to 2.5 inches. In some embodiments, distance B is between about 2.5 to 3.0 inches. In some embodiments, distance B is between about 3.0 to 3.5 inches. In some embodiments, distance B is more than about 3.5 inches. In some embodiments, distance C is between about 1.0 to 1.25 inches. In some embodiments, distance C is between about 1.25 to 1.5 inches. In some embodiments, distance C is between about 1.5 to 1.75 inches. In some embodiments, distance C is between about 1.75 to 2.0 inches. In some embodiments, distance C is more than about 2.0 inches.

As used herein, the term "about" refers to plus or minus 10% of the referenced number. For example, an embodiment wherein the rebar bending device 100 is about 20 inches in length includes a rebar bending device 100 that is between 18 and 22 inches in length.

Without wishing to limit the present invention to any theory or mechanism, it is believed that the device 100 of the present invention is advantageous because the device can be taken apart so that if parts wear out they can easily be replaced. For example, the extension plate and/or top plate (e.g., stainless steel rulers) can be replaced.

The following the disclosures of the following U.S. Patents are incorporated in their entirety by reference herein: U.S.

Pat. No. 5,669,258; U.S. Pat. No. 6,993,950; U.S. Pat. No. 4,009,602; U.S. Pat. No. 3,943,747; U.S. Pat. No. 4,798,078.

In summary, the present invention features a rebar bending device for allowing a user to bend a rebar. In some embodiments, the rebar bending device comprises a base plate having a top surface, a bottom surface, a first end, and a second end, wherein a first pin is disposed on and extends upwardly from the base plate at or near the second end of the base plate. In some embodiments, the rebar bending device comprises a rotator plate having a top surface, a bottom surface, a first end, and a second end, wherein a first pin aperture is disposed in the rotator plate near the first end, the first pin aperture is adapted to slide over the first pin on the base plate, wherein a third pin is disposed on the top surface of the rotator plate near the second end, the rotator plate is positioned atop the base plate and can pivot about the first pin.

In some embodiments, the rebar bending device comprises a handle disposed on the second end of the rotator plate, the handle helps the rotator plate to be rotated about the first pin. In some embodiments, the rebar bending device comprises a top plate having a top surface, a bottom surface a first end, and a second end, wherein a second pin aperture is disposed in the top plate at the second end, the second pin aperture is adapted to slide over the first pin of the base plate such that the second end of the top plate is placed atop the rotator plate, wherein a space exists between a portion of the top plate and a portion of the base plate, wherein a second pin is disposed on the top surface of the top plate near the second pin aperture, wherein an attachment means connects the top plate to the base plate.

In some embodiments, the rebar bending device comprises a second arc-shaped slot disposed in the top plate surrounding at least a portion of the second pin aperture. In some embodiments, the rebar bending device comprises a second marker plate either integrated into the top surface of the top plate or disposed atop the top plate, the second marker plate is labeled with a plurality of measurement markers, wherein a third pin aperture is disposed in the second marker plate to accommodate the first pin and a fourth pin aperture is disposed in the second marker plate to accommodate the second pin, wherein a third arc-shaped slot is disposed in the second marker plate surrounding the third aperture, the third arc-shaped slot aligns with the second arc shaped slot on the top plate.

In some embodiments, the rebar bending device comprises a dial comprising dial measurement markings disposed in between the third pin aperture and the third arc-shaped slot and outside of the third arc-shaped slot. In some embodiments, the rebar bending device comprises a dial pin slidably inserted into the third arc-shaped slot and the second arc-shaped slot, the dial pin is mounted into a dial pin mount disposed on the rotator plate, the dial pin mount being aligned with the second arc-shaped slot. A rebar can be positioned in between the first pin, the second pin, and the third pin, wherein a user can bend a rebar by rotating the rotator plate via the handle.

In some embodiments, the rebar bending device further comprises a first extension plate, the first extension plate has a top surface, a bottom surface, a first end, and a second end, the first extension plate is aligned with and generally flush with the first end of the top plate. In some embodiments, a tab extending outwardly from the second end of the first extension plate, the tab is adapted to be sandwiched between the base plate and the first end of the top plate so as to secure the first extension plate to the base plate and top plate. In some embodiments, the rebar bending device further comprises a tab aperture disposed in the tab of the first extension plate. In some embodiments, the attachment means for connecting the top plate to the base plate includes a bolt that extends through a first bolt aperture in the top plate, through the tab aperture in the tab of the first extension plate, and through to a second bolt aperture in the base plate. In some embodiments, a first marker plate is either integrated into the top surface of the first extension plate or disposed atop the first extension plate, the first marker plate is labeled with a plurality of measurement markers.

In some embodiments, the rebar bending device further comprises a first supplemental aperture disposed in the top plate and a third supplemental aperture disposed in the base plate positioned below and aligned with the first supplemental aperture. In some embodiments, the rebar bending device further comprises a first supplemental pin inserted into both the first supplemental aperture and the third supplemental aperture, and extending upwardly from the top plate. In some embodiments, the rebar bending device further comprises a second supplemental aperture disposed in the top plate and a fourth supplemental aperture disposed in the base plate positioned below and aligned with the second supplemental aperture. In some embodiments, the rebar bending device further comprises a second supplemental pin inserted into both the second supplemental aperture and the fourth supplemental aperture, and extending upwardly from the top plate.

In some embodiments, the attachment means for connecting the top plate to the base plate includes a bolt that extends through a first bolt aperture in the top plate and through to a second bolt aperture in the base plate. In some embodiments, the attachment means for connecting the top plate to the base plate includes a connecting bolt/screw extending from the top plate to the base plate.

In some embodiments, the rebar bending device further comprises a support beam attached to the bottom surface of the base plate, wherein the support beam is adapted to allowing the rebar bending device to be mounted. In some embodiments, the rebar bending device further comprises an inner channel disposed in the support beam adapted to accept a secondary post. In some embodiments, the rebar bending device further comprises a locking knob disposed on the support beam, the locking knob functions to temporarily secure the support beam to the secondary post. In some embodiments, the first pin, the third pin, the rotator plate, or a combination thereof is equipped with a grease fitting.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A rebar bending device comprising:

(a) a base plate 120 having a top surface, a bottom surface, a first end, and a second end, wherein a first pin 210 is disposed on and extends upwardly from the base plate 120 at or near the second end of the base plate 120;

(b) a rotator plate 140 having a top surface, a bottom surface, a first end, and a second end, wherein a first pin aperture 140*a* is disposed in the rotator plate 140 near the first end, the first pin aperture 140*a* is adapted to slide over the first pin 210 on the base plate 120, wherein a third pin 230 is disposed on the top surface of the rotator plate 140 near the second end, the rotator plate 140 is positioned atop the base plate 120 and can pivot about the first pin 210;

(c) a handle 250 disposed on the second end of the rotator plate 140, the handle 250 helps the rotator plate 140 to be rotated about the first pin 210;

(d) a top plate 150 having a top surface, a bottom surface a first end, and a second end, wherein a second pin aperture 152*a* is disposed in the top plate 150 at the second end, the second pin aperture 152*a* is adapted to slide over the first pin 210 of the base plate 120 such that the second end of the top plate 150 is placed atop the rotator plate 140, wherein a space exists between a portion of the top plate 150 and a portion of the base plate 120, wherein a second pin 220 is disposed on the top surface of the top plate 150 near the second pin aperture 152*a*, wherein an attachment means 159 connects the top plate 150 to the base plate 120;

(e) a second arc-shaped slot 152*b* disposed in the top plate 150 surrounding at least a portion of the second pin aperture 152*a;*

(f) a second marker plate 150*a* either integrated into the top surface of the top plate 150 or disposed atop the top plate 150, the second marker plate 150*a* is labeled with a plurality of measurement markers 300, wherein a third pin aperture 150*c* is disposed in the second marker plate 150*a* to accommodate the first pin 210 and a fourth pin aperture 150*d* is disposed in the second marker plate to accommodate the second pin 220, wherein a third arc-shaped slot 412 is disposed in the second marker plate 150*a* surrounding the third aperture, the third arc-shaped slot 412 aligns with the second arc shaped slot 152*b* on the top plate 150;

(g) a dial 410 comprising dial measurement markings 416 disposed in between the third pin aperture 150*c* and the third arc-shaped slot 412 and outside of the third arc-shaped slot 412; and (h) a dial pin 412*a* slidably inserted into the third arc-shaped slot 412 and the second arc-shaped slot 152*b*, the dial pin 412*a* is mounted into a dial pin 419*a* mount disposed on the rotator plate 140, the dial pin mount 419*a* being aligned with the second arc-shaped slot 152*b;* wherein a rebar can be positioned in between the first pin 210, the second pin 220, and the third pin 230, wherein a user can bend a rebar by rotating the rotator plate 140 via the handle 250, wherein the dial pin 412*a* rotates with the handle 250 and rotator plate 140.

2. The rebar bending device of claim 1 further comprising a first extension plate 130, the first extension plate 130 has a top surface, a bottom surface, a first end, and a second end, the first extension plate 130 is aligned with and generally flush with the first end of the top plate 150.

3. The rebar bending device of claim 2, wherein a tab 139 extending outwardly from the second end of the first extension plate, the tab 139 is adapted to be sandwiched between the base plate 120 and the first end of the top plate 150 so as to secure the first extension plate 130 to the base plate 120 and top plate 150.

4. The rebar bending device of claim 3 further comprising a tab aperture 139*a* disposed in the tab 139 of the first extension plate.

5. The rebar bending device of claim 4, wherein the attachment means for connecting the top plate to the base plate includes a bolt 159 that extends through a first bolt aperture in the top plate 150, through the tab aperture 139*a* in the tab 139 of the first extension plate 130, and through to a second bolt aperture in the base plate 120.

6. The rebar bending device of claim 2, wherein a first marker plate 130*a* is either integrated into the top surface of the first extension plate 130 or disposed atop the first extension plate 130, the first marker plate 130*a* is labeled with a plurality of measurement markers 300.

7. The rebar bending device of claim 1 further comprising a first supplemental aperture 420*a* disposed in the top plate 150 and a third supplemental aperture 420*c* disposed in the base plate 120 positioned below and aligned with the first supplemental aperture 420*a*.

8. The rebar bending device of claim 7 further comprising a first supplemental pin 430*a* inserted into both the first supplemental aperture 420*a* and the third supplemental aperture 420*c*, and extending upwardly from the top plate 150.

9. The rebar bending device of claim 1 further comprising a second supplemental aperture 420*b* disposed in the top plate 150 and a fourth supplemental aperture 420*d* disposed in the base plate 120 positioned below and aligned with the second supplemental aperture 420*b*.

10. The rebar bending device of claim 9 further comprising a second supplemental pin 430*b* inserted into both the second supplemental aperture 420*b* and the fourth supplemental aperture 420*d*, and extending upwardly from the top plate 150.

11. The rebar bending device of claim 1, wherein the attachment means for connecting the top plate to the base plate includes a bolt 159 that extends through a first bolt aperture in the top plate and through to a second bolt aperture in the base plate.

12. The rebar bending device of claim 1, wherein the attachment means for connecting the top plate to the base plate includes a connecting bolt/screw extending from the top plate to the base plate.

13. The rebar bending device of claim 1 further comprising a support beam 110 attached to the bottom surface of the base plate, wherein the support beam 110 is adapted to allowing the rebar bending device to be mounted.

14. The rebar bending device of claim 13 further comprising an inner channel disposed in the support beam 110 adapted to accept a secondary post 510*a*.

15. The rebar bending device of claim 13 further comprising a locking knob 480 disposed on the support beam 110, the locking knob 480 functions to temporarily secure the support beam 110 to the secondary post 510*a*.

16. The rebar bending device of claim 1, wherein the first pin 210, the third pin 230, the rotator plate 140, or a combination thereof is equipped with a grease fitting.

* * * * *